United States Patent [19]

LaBelle et al.

[11] 3,964,709

[45] June 22, 1976

[54] NAIL POLISH BOTTLE RETAINER

[75] Inventors: Joan P. LaBelle; George Ketz, Jr., both of Minneapolis, Minn.

[73] Assignee: Joseph Jay by said Joan P. LaBelle and George Ketz, Jr. Kopstein, Tampa, Fla. ; a part interest

[22] Filed: Oct. 24, 1975

[21] Appl. No.: 625,505

[52] U.S. Cl. ..... 248/133; 211/73; 211/74; 222/164; 248/174; 248/311.1; 248/350

[51] Int. Cl.[2] ..... A47F 5/12; A47G 29/00

[58] Field of Search ..... D19/84, 85, 93; D86/10 C; 211/69.1–69.7, 71–74; 248/128, 130, 133, 143, 152, 174, 300, 309–312, 346, 349, 350; 222/164–166, 584

[56] References Cited

UNITED STATES PATENTS

| | | | |
|---|---|---|---|
| 1,277,838 | 9/1918 | Billard | 248/346 |
| 1,425,550 | 8/1922 | Spiro | 248/300 X |
| 1,655,911 | 1/1928 | Magid | 211/69.7 |
| 2,596,009 | 5/1952 | Connor et al. | 248/310 X |
| 2,633,248 | 3/1953 | Goldenberg | 211/74 |
| 2,659,920 | 11/1953 | Bogan et al. | 248/350 X |
| 2,748,952 | 6/1956 | Fleit et al. | 248/349 X |
| 2,883,133 | 4/1959 | Zarate | 248/174 X |
| 2,963,167 | 12/1960 | Norman | 211/74 |
| 3,090,590 | 5/1963 | Hester | 248/346 |
| 3,220,685 | 11/1965 | Himler | 248/350 |

FOREIGN PATENTS OR APPLICATIONS

| | | | |
|---|---|---|---|
| 17,411 | 5/1934 | Australia | 248/133 |
| 27,509 | 11/1913 | United Kingdom | 248/311 R |
| 221,739 | 9/1924 | United Kingdom | 248/152 |

*Primary Examiner*—Roy D. Frazier
*Assistant Examiner*—Lawrence J. Staab
*Attorney, Agent, or Firm*—Orrin M. Haugen

[57] ABSTRACT

A support means for retaining and adjustably positioning a cosmetic bottle receptacle in a predetermined disposition along and about an arc extending from a generally upright disposition to a tilted disposition generally 45° from said upright disposition. The support means includes an elongated flexible continuous body with a base pad portion, bottle base engaging support leg extending from one end of the base pad, and a bottle retaining portion extending from the opposed end of the base pad. The bottle retaining portion has an arcuate configuration, and is provided with a slotted zone through which the neck portion of a bottle is received, with lateral edge strips along the slotted zone being arranged to abut against the shoulder of a bottle being retained therewithin.

3 Claims, 5 Drawing Figures

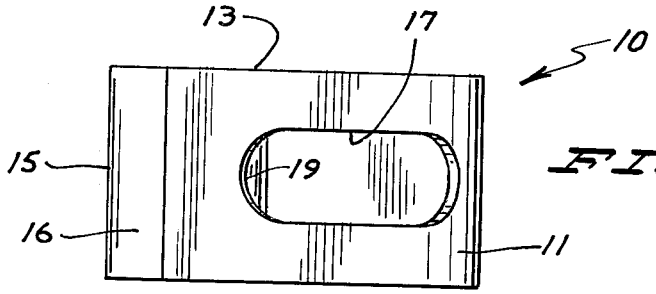
FIG. 2
FIG. 1
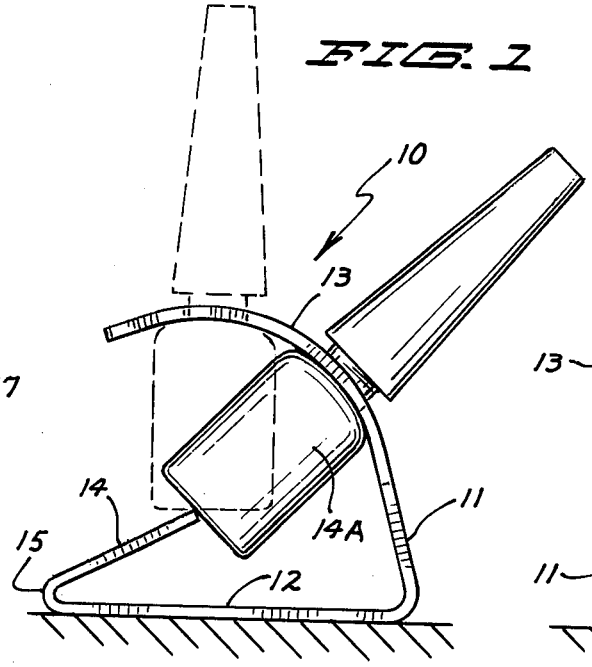
FIG. 3
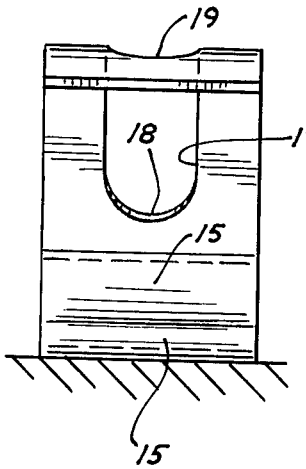
FIG. 4
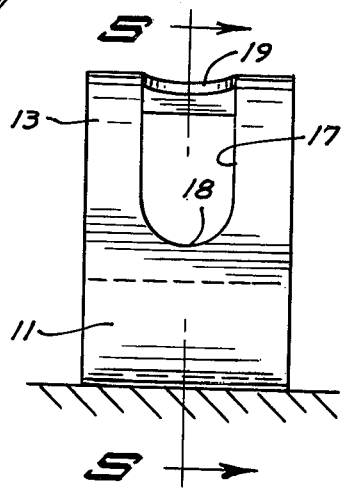
FIG. 5
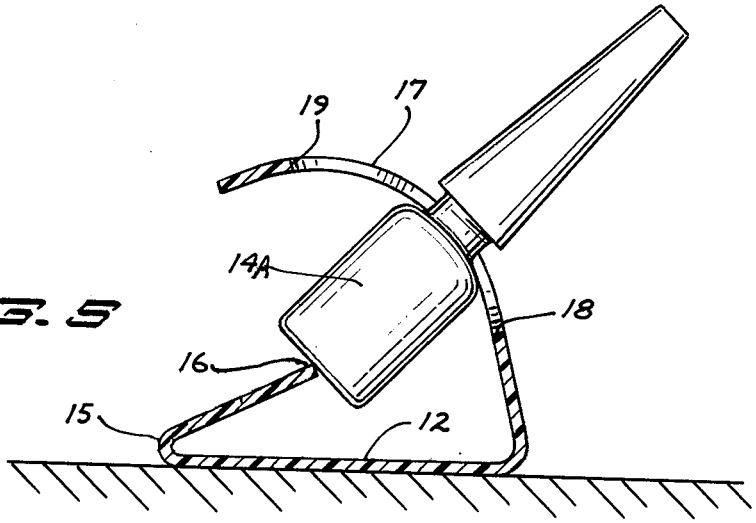

NAIL POLISH BOTTLE RETAINER

BACKGROUND OF THE INVENTION

The present invention relates generally to an improved bottle support means, and more particularly to a bottle support means particularly adapted to retain and position a cosmetic bottle receptacle in a predetermined and adjustable disposition therewithin. The structure of the present invention is particularly adapted for use in connection with bottles of nail polish and the like, which, because of the viscosity of the liquid, are normally retained in tilted disposition for extended periods of time during use.

In the use of cosmetic receptacles, particularly nail polish bottles and the like, the user, because of the geometry of the bottle, will wish to retain the bottle at an angular disposition in order to periodically insert and withdraw the brush element normally provided on the cap portion from the interior of the bottle. In this fashion, the user may repeatedly obtain fresh quantities of polish on the brush for application. Normally, when the user is applying polish to the surface of her fingernails, her hands will be sufficiently occupied so as to render the periodic tilting of the container difficult, cumbersome, and undesirable. In addition, the periodic tilting may result in inadvertent spillage of the contents, thereby risking danger to surfaces which come in contact with the spilled liquid. The solvent for nail polish is frequently ethyl acetate, or other highly volatile material, and the surface of pieces of furniture may become damaged upon exposure to these materials. Accordingly, it has been found to be desirable to provide a stable support means for cosmetic bottle receptacles, with the support means being arranged and adapted to accommodate any of a variety of normal bottles or receptacles. The support means of the present invention accommodates the bottles in a variety of angular dispositions, from a generally upright disposition to a tilted disposition which is generally 45° from the upright disposition. This arrangement provides good visibility for the user and enables her to insert and withdraw the brush readily for continued application of a material such as nail polish to the surface of her fingernails.

SUMMARY OF THE INVENTION

Therefore, it is a primary object of the present invention to provide an improved support means for retaining and adjustably positioning and securing cosmetic bottles within a support element, the arrangement providing for adjustable positioning of such a receptacle from a generally upright disposition to a tilted disposition generally 45° from said upright disposition.

It is a further object of the present invention to provide an improved support means for retaining and adjustably positioning cosmetic bottles or receptacles within said support means, the support means being formed from a material which is flexible and resilient, and which may flex so as to accommodate a substantial variety of nail polish bottles, and bottles or receptacles.

It is yet a further object of the present invention to provide an improved support means for a cosmetic bottle or receptacle wherein the structure will retain a nail polish bottle therewithin in stable predetermined disposition, extending from a generally upright disposition to a tilted disposition which is generally 45° from said upright disposition.

Other and further objects of the present invention will become apparent to those skilled in the art upon a study of the following specification, appended claims, and accompanying drawing.

BRIEF DESCRIPTION OF THE DRAWING

FIG. 1 is a side elevational view of the support means of the present invention, and illustrating, in full lines, a conventional nail polish bottle being held therewithin, and further illustrating, in phantom, the nail polish bottle in alternate generally upright disposition;

FIG. 2 is a top plan view of the support means illustrated in FIG. 1;

FIGS. 3 and 4 are rear and front views respectively of the support means illustrated in FIG. 1; and FIG. 5 is a vertical sectional view taken along the line and in the direction of the arrows 5—5 of FIG. 4.

DESCRIPTION OF THE PREFERRED EMBODIMENT

In accordance with the preferred embodiment of the present invention, the support means structure shown includes a continuous elongated flexible support body generally designated 10 having a bottle retaining portion 11 extending upwardly from a base pad portion 12, the bottle retaining portion 11 having an arcuate segment 13 formed integrally therewith. A bottle engaging support leg portion 14 extends in a plane at an acute angle from the plane of the base pad portion 12, support leg 14 being in continuation with base pad 12, and joining base pad 12 through arcuate coupling zone 15. Receptacle bottle 14A is shown being retained within the support means, with the bottle including the conventional neck and shoulder segments, and the threaded cap element as well.

Support leg portion 14 terminates in a terminal edge 16, this edge, as indicated, providing a base support for the receptacle 14A. As will become apparent, terminal edge 16 is generally disposed at the center of the arc through which the bottle retaining portion is formed.

As has been indicated, the entire structure is formed as a continuous elongated member which is flexible and resilient, the flexural characteristics provide a spring factor which generally rigidly or securely retains the bottle in its desired elevation. In this connection, terminal edge 16 provides a constant and consistent bottom stop or resting member upon which the retained bottle may rest. Terminal edge 16 also provides a line contact from the radius point, with the radius of arc of portion 13 being generally smooth and continuous.

For most bottles, in order to achieve a tiltable characteristic of approximately 45°, it will be generally necessary to provide approximately 65° of arc from the horizontal, thereby achieving a capability of tilting at an angle greater than about 45°. Therefore, the extent of the slotted zone 19 will extend or span approximately 65° of arc. A termination point for the slotted zone 19 will be, of course, approximately the diameter of the slotted zone.

With continued attention being directed to the bottle retaining portion 13, such as illustrated in FIGS. 2, 3 and 4, the slotted zone 19 is flanked by lateral edge strips such as at 17, thereby providing continuous flexural support for the bottle confined therewithin. Arcuate stops are provided such as at 18, to restrict or otherwise control the extent to which the bottle may be tilted within the confines of the device.

For a typical cosmetic bottle of the nail polish variety, the width of the slotted zone should be approximately 13/16th-inch, this width accommodating most of the conventional nail polish bottles being sold commercially. The radial distance between terminal edge 16 and the under-surface of the arcuate portion 13 should be approximately 1-⅜-inches, thus further establishing a convenient height which will accommodate most of those nail polish cosmetic bottles being sold commercially. The length of base pad 12 should be approximately 2 inches to 3 inches, and preferably about 2-½-inches in order to accommodate and stably support nail polish or other cosmetic bottles. Also, in order to achieve uniformity, the leg portion 14 extends angularly upwardly from base pad 12, as is indicated.

While the structure of the present invention may be formed from conventional plastics such as polystyrene, vinyl, or the like, it is further appreciated that the structure may be formed of wire or resilient metal. Methylmethacrylate may also be employed if desired.

We claim:

1. Support means for retaining and adjustably positioning and securing cosmetic bottle receptacles in predetermined disposition about an arc extending from a generally upright disposition to a tilted disposition generally 65° from said upright disposition, said support means comprising:

a. an elongated continuous flexible support body having a base pad portion, a bottle engaging support leg in a plane disposed at an acute angle from the plane of said base pad portion and extending from one end of said base pad portion, and a bottle retaining portion extending from the opposed end of said base pad portion;

b. said bottle engaging support leg portion terminating along a terminal edge disposed in elevated disposition relative to the plane of said base pad portion;

c. said bottle retaining portion having a generally arcuate configuration with the center of arc being generally coincidental with said terminal edge and with said bottle retaining portion being elevated above said terminal edge and having a surface in opposed disposition to said terminal edge, and slot means being formed within said bottle retaining portion between lateral edge strip zones, said slot being arranged to receive and retain only the neck portion of a cosmetic bottle therewithin, and with the base of said lateral edge strips being arranged to abut against the shoulder of a bottle being retained therewithin;

d. the arrangement being such that upon inserting a bottle within said support means and upon said terminal edge, said bottle retaining portion flexes resiliently away from said terminal edge so as to grip the bottle between said terminal edge and the inner surface of said arcuate bottle retaining portion.

2. The support means as defined in claim 1 being particularly characterized in that said support body is fabricated from a flexible and resilient synthetic resinous material.

3. The support means as defined in claim 1 being particularly characterized in that the radial distance between said terminal edge and the inner surface of said bottle retaining portion is less than the shoulder height of a conventional cosmetic bottle to be retained therewithin.

* * * * *

UNITED STATES PATENT OFFICE

CERTIFICATE OF CORRECTION

PATENT NO. : 3,964,709

DATED : June 22, 1976

INVENTOR(S) : Joan P. LaBelle and George Ketz, Jr.

It is certified that error appears in the above-identified patent and that said Letters Patent are hereby corrected as shown below:

Item [73], "Joseph Jay by said Joan P. LaBelle and George Ketz, Jr. Kopstein" should read -- Joseph Jay Kopstein by said Joan P. LaBelle and George Ketz, Jr. --.

Column 1, line 43, after the word "brush" insert -- element --.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*